United States Patent [19]

Teshima et al.

[11] 4,271,408

[45] Jun. 2, 1981

[54] COLORED-LIGHT EMITTING DISPLAY

[75] Inventors: Toru Teshima, Yokohama; Jun-ichi Nishizawa, Sendai; Yasunori Kishi, Tokyo, all of Japan

[73] Assignee: Stanley Electric Co., Ltd., Tokyo, Japan

[21] Appl. No.: 84,384

[22] Filed: Oct. 12, 1979

[30] Foreign Application Priority Data

| | | | |
|---|---|---|---|
| Oct. 17, 1978 | [JP] | Japan | 53-127726 |
| Oct. 17, 1978 | [JP] | Japan | 53-127727 |
| Oct. 17, 1978 | [JP] | Japan | 53-127728 |
| Oct. 17, 1978 | [JP] | Japan | 53-127729 |

[51] Int. Cl.[3] ..... G08B 5/36

[52] U.S. Cl. ..... 340/702; 40/564; 40/581; 340/366 B; 340/782

[58] Field of Search ..... 340/366 R, 366 B, 702, 340/780, 782; 40/564, 581, 582, 583

[56] References Cited

U.S. PATENT DOCUMENTS

| | | | |
|---|---|---|---|
| 1,626,286 | 4/1927 | Keenan | 40/564 |
| 2,038,409 | 4/1936 | Bone | 40/564 |
| 3,161,853 | 12/1964 | Hart | 340/366 R |
| 3,163,949 | 1/1965 | Gley | 340/780 X |
| 3,845,468 | 10/1974 | Smith | 340/366 B |
| 4,056,733 | 11/1977 | Prestridge | 340/782 X |

*Primary Examiner*—David L. Trafton

*Attorney, Agent, or Firm*—Cushman, Darby & Cushman

[57] ABSTRACT

A plurality of cellular concave mirror surfaces are formed on a plate-like reflector unit, and a plurality of light-emitting diodes are disposed on these cellular concave mirror surfaces to jointly form a colored light source. Connection wirings to be connected with a power supply source are provided on a substrate laminated with the reflector unit. A lamp base of a conventional type may be coupled to the substrate for being electrically connected to the wirings. This colored light source can provide a single or multiple color displays. Improved shadow pattern display can be provided by forming a complementary color pattern on a front cover lens. Letter, symbol or pattern display can be provided by selectively arranging light-emitting diodes on the reflector unit. In case the above-mentioned light source is used as a traffic signal device, power dissipation and maintenance care are reduced by the light-emitting diodes having low power consumption and long service life, and high security of the traffic is assured by the elimination of false indications caused by external lights.

20 Claims, 23 Drawing Figures

FIG. 17
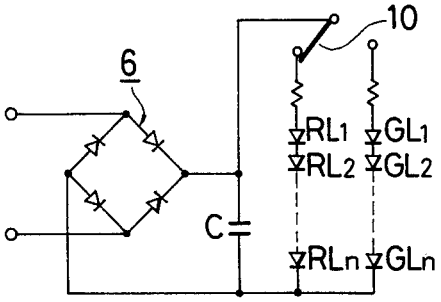
FIG. 18
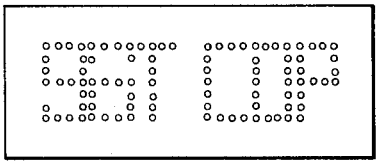
FIG. 19
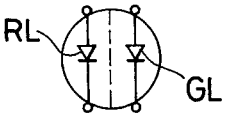
FIG. 20
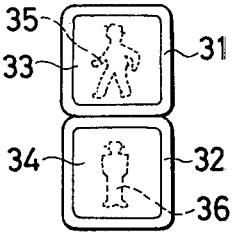
FIG. 21
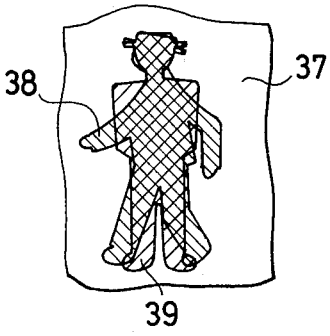
FIG. 22
| | | | | |
|---|---|---|---|---|
| G | R | G | R | G |
| R | G | R | G | R |
| G | R | G | R | G |

COLORED-LIGHT EMITTING DISPLAY

BACKGROUND OF THE INVENTION (a) Field of the Invention

The present invention relates to a display device, and more particularly it pertains to a colored-light display device utilizing light-emitting diodes serving as light source constituting elements.

(b) Description of the Prior Art

Most of the colored-light emitting display devices, such as traffic signal devices and railroad signal devices, employ incandescent lamps serving as light sources, and also color filter means for coloring the display lights. For example, a city road traffic signal device comprises a plurality of lamp units, each comprising a reflecting mirror, an incandescent lamp disposed on the reflecting mirror to serve as the light source, and a colored front cover lens arranged in the foreground of the reflecting mirror. The reflecting mirror, the light source and the cover lens are arranged at predetermined positions within a housing. City traffic continues day and night throughout the year, and hence the city traffic signal devices mostly are required to be operated day and night for the control and security of the traffic. This means that the incandescent lamps serving as the light sources of such traffic signal devices should be turned on and off frequently day and night. Furthermore, traffic signal devices which are installed outdoors are subjected directly to varying severe environmental conditions such as temperature and weather. Therefore, there are many factors that can cause malfunctions of the signal device, including disconnection of lamps. Thus, sufficient care, and hence considerable cost, need to be paid for the maintenance of the system. Furthermore, since the incandescent lamp supplies only white color lights, a coloring filter such as a colored cover lens is required for coloring the display lights. Filtering away of those unnecessary lights other than the light of a desired color such as green, yellow or red results in a reduction in the intensity of illumination or brightness and also in a low efficiency of conversion of electric power to a usable light energy. To compensate for such low efficiency, it is inevitable to use a light source of high wattage for obtaining sufficient brightness of display. A large power consumption, however, contributes to a large heat generation, and leads to a remarkable rise of the temperature within the lamp housing. Therefore, consideration should be paid not only to finding means to cope with the variations in the environmental conditions, but also to find means to cope with the variations of the temperature within the lamp housing. Such being the actual circumstances, the overall structure of signal devices for controlling the city traffic has tended to be large in size and complicated in mechanism. Signal devices for controlling the railway traffic have similar problems also.

Furthermore, another problem comes to the fore in case a signal lamp device which is provided with a coloring filter at the front cover or foreground surface of the device is installed at such location where the coloring filter is subjected to direct irradiation of intensive lights such as the sunlight. Such sunlight which is transmitted to the device through the coloring filter is subjected to being colored through the filtering function thereof, and is reflected by the reflector member or like member, and is caused thereby to emit outwardly of the device through this filter. Such reflected colored light from the signal lamp device could tend to give false indication to the viewer as if the signal which, in reality, is turned off looks like working. This kind of false indication cannot be prevented in those conventional signal devices having such structure as stated above. Such false indications could lead to traffic accidents. Among the conventional traffic signals, shadow signal lamp devices intended for pedestrians such as a device which displays a shadow figure of a moving person against a blue-color background or a shadow figure of a waiting or standing-still posture on a red-color background tend to have the above-said problems especially, because of the relatively low degree of brightness of the colored display surface and/or because of the white or semi-transparent shadow figures provided on the surface of the device. Similar signal lamp devices include a colored "GO" and "STOP" sings.

As will be understood from the foregoing statement, most of the inconveniences and drawbacks of those conventional colored-light emitting display devices may be attributed to the use of a combination of an incandescent lamp and a coloring filter.

For the purpose of colored-light display, the employment of light-emitting diodes is advantageous as compared with the incandescent lamps, with respect to such aspects as low power operation, negligible heat generation, long service life and high luminous effciency. Further development of colored-light display devices using light-emitting diodes have been demanded.

SUMMARY OF THE INVENTION

It is, therefore, an object of the present invention to provide a colored-light emitting display device which is simple in structure and has an improved luminous efficiency.

Another object of the present invention is to provide a colored-light emitting display device as described above, which is practically free of disconnections from the light source and needs little care for its maintenance.

Still another object of the present invention is to provide a colored-light emitting display device of the type as described above, which is practically free of making false indication regardless of ambient conditions of light.

A further object of the present invention is to provide a colored-light emitting display device of the type described above, which is capable of selectively displaying a plurality of colored signals on a same front display surface.

According to an embodiment of the present invention, there is provided a signal device comprising a housing carrying therein a transparent or semitransparent colorless front cover lens, a substrate carrying thereon electric connection wiring led to a power supply source, a plate-like reflector unit laminated on said substrate and having thereon a plurality of individual cellular concave mirror surfaces, and a plurality of light-emitting diodes disposed on the cellular concave mirror surfaces and connected to the wirings arranged on the substrate for being energized to emit colored lights. Each of said cellular concave mirror surfaces of the reflector unit is provided with a light-emitting diode so that the distribution of light emitted therefrom can be controlled very effectively by the concave mirror surface. The employment of light-emitting diodes eliminates the use of a color filter, and enables the device to carry out a lowpower and high brightness operation, and provides a semi-permanent service life.

A lamp base of a conventional type may be connected to the wirings-carrying substrate to afford compatibility with and convenience for the conventional light-signal systems.

According to another aspect of the present invention, there is provided a light-emitting signal device which enables a complementary color pattern to be provided on preferably the inner surface of the front cover lens to provide a black shadow display on a colored background. Selective superposed shadow displays can be provided also by the employment of lights of different colors. Recognition of the displayed signal can be highly enhanced through the non-false display arrangement including the transparent front cover lens.

According to still another aspect of the present invention, there is provided a light-emitting signal device which enables selective displays of different colors on a same display surface to be achieved easily by the employment of a selection switch and a plurality of groups of light-emitting diodes which are operatively connected to this switch, each group including series-connected light-emitting diodes and emitting a particular color of their own.

According to a further embodiment of the present invention, each light-emitting diode is surrounded by frame walls having open opposite ends. This arrangement enhances the clarity of a pattern display because the effect of the ambient lights is reduced by this frame wall and because the emitting light of the diode is prevented from diffusing divergently.

According to a still further embodiment of the present invention, plural series connections of light-emitting diodes are connected in parallel, and this arrangement allows one to make free selection of the driving voltage to vary the intensity of the output light.

Furthermore, by driving light-emitting diodes with an ac power, the power source can be simplified, and brings forth compatibility with the conventional system.

These as well as other objects, the features and the advantages of the present invention will become apparent by reading the following detailed description of the preferred embodiments when taken in conjunction with the accompanying drawings.

BRIEF DESCRIPTION OF THE DRAWINGS

FIGS. 9, 10, 11 and 12 are another embodiment of the present invention, in which:

FIG. 9 is a diagrammatic perspective exploded explanatory illustration of a part of an assembly of a substrate and a reflector unit carrying light-emitting diodes for use, generally, in various embodiments of the present invention;

FIG. 10 is a circuit diagram of a selective colored light display lamp device;

FIG. 11 is a diagrammatic cross-sectional view of a lamp unit; and

FIG. 12 is a diagrammatic plan view of a part of a reflector unit showing the arrangement of light-emitting diodes of three different colors.

FIGS. 13 through 17 represent another embodiment of the present invention, in which:

FIG. 13 is a diagrammatic representation of a general perspective view of the device;

FIG. 14 is a diagrammatic perspective view of a part of an assembly of a reflector unit carrying light-emitting diodes, frame walls assigned for separating the respective cells of the light-emitting diodes, and a front cover panel or lens;

FIG. 16 is a diagrammatic cross-sectional view of a part of a lamp device of FIG. 14; and FIG. 17 is a circuit connection diagram for use in the device of FIG. 14.

FIG. 18 is a diagrammatic representation of a front view of a display device intended for selective display of different signals on a same display surface.

FIG. 19 is a diagrammatic illustration of a unit display area of the device containing two light-emitting diodes of different colors for two different color displays.

FIG. 20 is a diagrammatic illustration of a shadow display signal device according to another embodiment of the present invention, for displaying two different shadows, one at a time, on two display devices.

FIGS. 21 and 22 are another embodiment of the present invention intended for selective shadow display, in which:

FIG. 21 is a diagrammatic front view of a part of the display device; and

FIG. 22 is a diagrammatic representation of arrangement of light-emitting diodes of two different colors.

DETAILED DESCRIPTION OF THE PREFERRED EMBODIMENTS

In accordance with the present invention, there are materialized various types of colored-light emitting signal lamp devices as a substitution of the conventional combination of an incandescent lamp and a coloring filter, by the employment of light-emitting diodes.

Description will hereunder be made of some preferred embodiments of the present invention.

Figure 1:
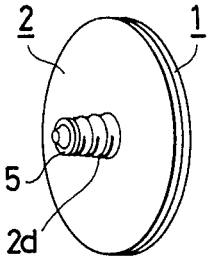
FIG. 1 is a diagrammatic explanatory perspective view, taken at the back, of a light-emitting diode lamp device according to an embodiment of the present invention.

FIG. 1 shows a diagrammatic perspective view of a lamp body as viewed from its rear side, according to an embodiment of the present invention. This lamp body includes a plate-like reflecting mirror unit 1, a substrate 2 underlying this mirror unit 1 and carrying thereon electric connections, and a lamp base 5 illustrated in the form of Edison base. The reflecting mirror unit 1 and the substrate 2 may be integrally formed into a single unit, or they may be formed separately and then the two may be assembled together to provide an integral body. The lamp base may be of any other type than the Edison base. For the purpose of providing a sufficient amount (flux) of light, a multiplicity of light-emitting diodes are mounted on the reflecting mirror unit 1.

Figure 2:
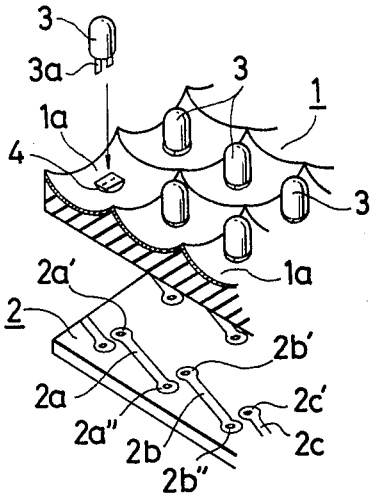
FIG. 2 is a diagrammatic perspective exploded explanatory illustration of a part of an assembly of a substrate and a reflector unit carrying light-emitting diodes for use, generally, in various embodiments of the present invention.

FIG. 2 shows an example of the manner of arranging said multiplicity of light-emitting diodes on the reflecting mirror unit 1 as well as the manner of connecting these light-emitting diodes to printed wirings carried on the substrate 2. These plural light-emitting diodes 3 emit lights of a certain color such as red, yellow or green. For enriching the hue of the emitting lights, there may be employed a combination of a plural kinds of light-emitting diodes. The reflecting mirror unit 1 is formed as an integrally molded plastic (synthetic resin) plate having a multiplicity of mirror cells 1*a* which are formed with spherical or parabolic cellular concave individual surfaces arranged on one surface of the plate. These mirror surfaces may be formed with a metal such as aluminum deposition. For example, aluminum is vacuum-deposited on a mirror plate and a transparent thin protective resion or dielectric film may be coated thereon. At the central portion of each reflecting mirror cell 1*a*, there is provided a socket 4 for loading a light-emitting diode 3. The mirror surface which forms one cell 1*a* is designed so as to be able to effectively lead the light emitting from the mating light-emitting diode 3 in a predetermined direction. The multiplicity of light-emitting diodes 3 combined with the corresponding multiplicity of mirrors cells 1*a* jointly form an overall light source for irradiating lights of a desired color in the desired directions. The solid angle of the emitting lights can be adjusted easily and in a wide range by designing the shape of the respective cellular mirror surfaces 1*a* in a desired manner and by selecting the positions of the light-emitting diodes 3 which are arranged on these mirror surfaces. It should be noted that a parabolic mirror cell has an ability of directing light rays much superior to that of a spherical mirror cell. Selection of the mirror shape may be done in accordance with the specific purpose. If desired, a combination of various different shapes of mirror cells may be adopted.

The substrate 2 is made with a board of an insulating material carrying a metal layer printed thereon for electrically connecting the multiplicity of light-emitting diodes. This substrate 2 is adapted to be brought into a close or tight contact with the bottom surface of the reflector mirror unit 1. In the example shown in FIG. 1, there are formed a plurality of printed wirings 2*a*, 2*b*, 2*c*, . . . on that surface of the insulator board 2 on which the mirror member 1 is brought into contact. The adjacently located end portions 2*a*'' and 2*b*' of the adjacently located wirings 2*a* and 2*b* jointly constitute a pair of receptors for a pair of terminals 3*a* of a single light-emitting diode 3 for the electric connection of this diode. Likewise, the two end portions 2*b*'' and 2*c*' of the two wirings 2*b* and 2*c* jointly form a pair of receptors for the connection of another light-emitting diode 3. In this way, a plurality of light-emitting diodes 3 may be electrically connected in series through these wirings 2*a*, 2*b*, 2*c*, . . . . Since a single light-emitting diode has a low driving voltage such as about 1.6 to 1.8 volts in case of a red-light emitting gallium-aluminum arsenide ($Ga_xAl_{1-x}A_5$, wherein $0<x<1$) diode, multiplication of such unit driving voltage is advantageous for the driving of the light-emitting diode circuit by a commercial power supply or like power source. For example, a series connection of 62 light-emitting diodes each having a driving voltage of 1.6 volts will make the total driving voltage of about dc 100 volts.

In case a single series connection of light-emitting diodes is unable to provide a sufficient intensity of light (illumination), there may be formed a parallel connection of such series connection, as will be described later.

The rear surface of the substrate 2 mentioned above is coupled to, for example, a lamp base 5 (see FIG. 1). In FIG. 1, the substrate 2 has, on its back side, a guide projection 2*d*, and the lamp base 5 is coupled tightly thereto by, for example, an adhesive agent or like means. The printed wirings 2*a*, 2*b*, 2*c*, . . . and the terminals of the lamp base 5 are electrically connected together by means of the socket. Alternatively, it will be apparent that soldering, compressed bonding and like means may be employed. It will be noted also that each of the light-emitting diodes may be replaced by a fresh one by merely removing it out of its mating socket 4 and inserting a new one into this socket.

Figure 3:
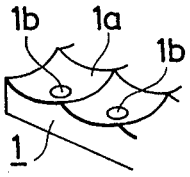
FIG. 3 is a diagrammatic perspective illustration of an alternative structure of individual concave surfaces of the reflector unit for substituting the reflector unit shown in FIG. 2.

An alternative structure of the reflecting mirror unit 1 is shown in FIG. 3. In this example, each mirror cell 1*a* of the mirror unit 1 is provided with no socket 4 for a light-emitting diode 3, but instead the mirror cell 1*a* is provided with a through-aperture 1*b*. Each of the light-emitting diodes 3 is mounted directly on the substrate 2 by inserting, via this through-aperture 1*b*, the terminals 3*a* of a light-emitting diode 3 into the receptors 2*a*'' and 2*b*', for example, of the wiring formed through the substrate 2, after passing through the mirror unit 1.

Figure 4:
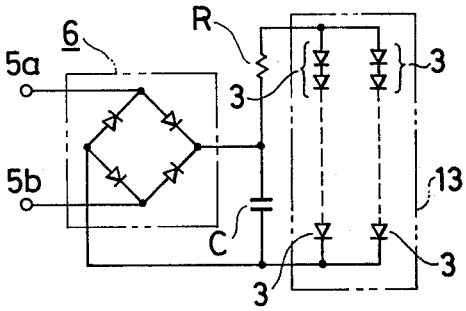
FIG. 4 is a circuit connection diagram to be employed in the embodiments of the present invention.

FIG. 4 shows an example of the circuit diagram for electrically connecting a plurality of light-emitting diodes. Input terminals 5*a* and 5*b* represent the contact points of the lamp base 5 and they are connected to an ac power supply not shown. A full-wave rectifying circuit 6 is connected between the input terminals 5*a* and 5*b* for supplying a pulsating dc power to the device. A capacitor C forms a smoothing circuit for absorbing ripple components of the power supply and for supplying a smoothed dc power to the light-emitting diodes. A protective resistor R is connected in series with a diode circuit 13. It should be understood that the rectifying circuit, the smoothing circuit and the protective resistor may be mounted inside the lamp base and/or on the substrate 2. As noted in FIG. 4, the light-emitting diode circuit 13 includes a parallel connection of two series connections of light-emitting diodes 3. The number of light-emitting diodes 3 in each series connection may be determined by giving consideration to the input voltage. Each series connection of light-emitting diodes may be considered as a component unit light source. Then, two such light source units are connected in parallel to raise the output light intensity in FIG. 4. It will be apparent that the number of such unit light sources may be selected arbitrarily to meet the desired light output. Various alterations and modifications of the diode circuit 13 is possible.

Figure 5:
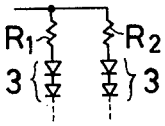
FIGS. 5 through 8 are partial circuit diagrams for substituting part of the circuit of FIG. 4.

FIG. 5 is a modification of a diode circuit arrangement shown in FIG. 4, and a protecting resistor $R_1$ and another protecting resistor $R_2$ are connected in series respectively to the respective series connections of the light-emitting diodes 3. These protecting resistors $R_1$ and $R_2$ may preferably be adjustable resistors which can balance the current dividing ratio and can compensate for the excess voltage which might be applied to the light-emitting diodes during, for example, the step of adjustment of the luminous intensity of the lamp device. In case two series connections of light-emitting diodes are employed as shown in FIG. 5, one of these two resistors $R_1$ and $R_2$ may be dispensed with.

Figure 6:
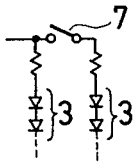

FIG. 6 is a modification of the diode circuit arrangements shown in FIG. 4 and 5. In this example, an additional series connection of light-emitting diodes 3 is connected in parallel, through a switching means 7, to the series connection of diodes 3 for varying the intensity of the output lights. This switch 7 may be closed during the daytime to give out a higher luminous flux, while it may be opened during the night time to reduce the luminous flux. Thus, a clear display can be achieved even in the circumstance wherein the intensity of the ambient light is great. Along therewith, this arrangement serves to minimize wasteful power dissipation during the night time.

Figure 7:
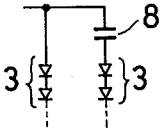

FIG. 7 shows a further modification of the light-emitting diode circuit arrangement, in which a capacitor 8 is connected to one or more of the series connections of light-emitting diodes 3. As will be understood by those skilled in the art, a phase shift is generated in the current which flows through the light-emitting diodes connected in series to this capacitor 8, and thus this arrangement serves to prevent the occurrence of flickers.

Figure 8:
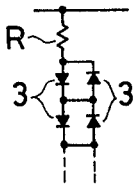

A light-emitting diode is capable of enduring a reverse voltage below the reverse breakdown voltage. Thus, a light-emitting diode circuit may be actuated by an ac power as well as by a dc power. FIG. 8 shows an example of a light-emitting diode circuit arrangement for ac drive. A pair of light-emitting diodes of opposite polarities relative to each other are connected in parallel, and a plurality of such pair connections are connected in series. The series connection is directly connected to an ac power surce through a protective resistor R, without the intervention of a rectifier circuit nor a smoothing circuit which is the case in FIG. 4. One of a pair of light-emitting diodes 3 emits light for every one half cycle and the other of the pair of the light-emitting diodes emits light for every other half cycle. Thus, the provision of a full-wave rectifier circuit is not needed.

According to those embodiments mentioned above, traffic signal lamp devices are formed by utilizing light-emitting diodes to serve as the light source, and hence the device has a semi-permanent service life, and markedly reduces cares required for the maintenance as compared with those signal devices using conventional incandescent signal lamps, and thus can simplify the structure because the provision of a coloring filter is not required, nor the provision of a heat radiating means. A desired amount of colored light can be emitted from the device by appropriately selecting the number of light-emitting diodes in a series connection of the arrangement as well as the number of the series circuits connected in parallel. Also, a convenient driving voltage can be selected by the adjustment of the number of the light-emitting diodes in each series circuit.

The emitting light rays can be effectively directed to desired directions by the use of parabolic and/or spherical reflecting mirror cells which accommodate light-emitting diodes, respectively. Particularly well oriented light rays can be obtained easily for road traffic signals and also for railroad traffic signals. Yet further, by assembling a lamp body as an integrated structure having a conventional lamp base, with the exception of the example of FIG. 6, the light-emitting diode lamp device can be made compatible with conventional signal lamp systems. A plurality of circuits as shown in FIG. 4 may be connected through a selection switch. Thus, the conventional signal systems utilizing incandescent light source can be reformed into those of light-emitting diodes step by step at each breakage of such incandescent lamp. In emergency, the light-emitting diode lamp device can be replaced by an incandescent lamp. It should be noted that such arrangement as that shown in FIG. 6 saves the wasteful electric power in dark condition merely by the addition of a simple arrangement.

The description made hereinabove has been directed mainly to those light-emitting diode lamp devices which emit light of a single color. The constituent light-emitting diodes each has a very small dimension, and thus there can be arranged a plurality of or a number of light-emitting diodes on a single plane in various desired ways. Rows of either red, yellow or green light emitting diodes can be assembled in a single lamp body without any difficulty.

Figure 9:
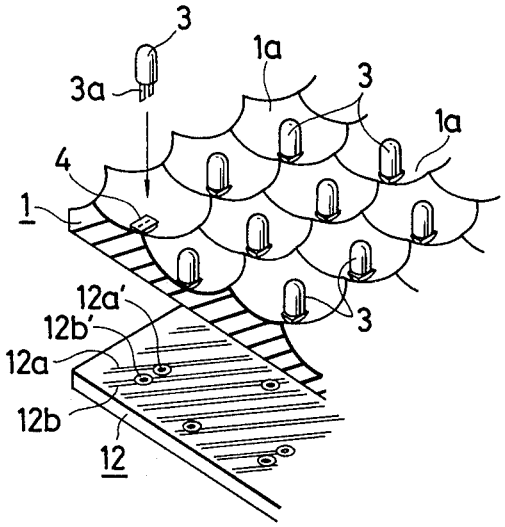
Figure 10:
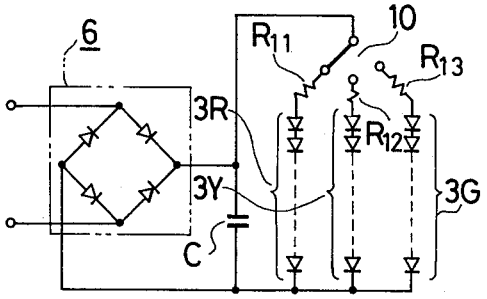
Figure 11:
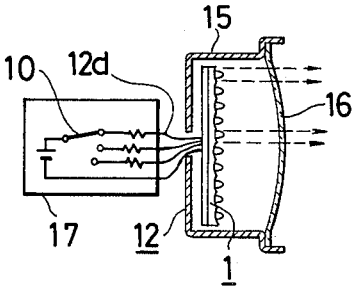

FIGS. 9, 10 and 11 show an example of composite light-emitting diode lamp device which is capable of selectively emitting light of either red, yellow or green in color. In FIG. 9, a reflector unit 1 is formed with an integral mold of a synthetic resin and carries on one surface thereof a plurality of concave cellular reflecting mirror surfaces 1*a* each having a similar shape. A socket 4 is provided in each of the reflecting mirror surfaces 1*a* at the central portion thereof for receiving the base portion of a light-emitting diode 3. A substrate 12 carries on its surface a plurality of paired printed wirings 12*a*, 12*b*, . . . for supplying electric power to the light-emitting diodes. Each of the paired printed wirings 12*a*, 12*b*, . . . has a connection hole 12*a*', 12*b*', . . . into which the base terminals not shown of the socket 4 are to be inserted to provide electric connection. Since red, yellow and green light emitting diodes are arranged on a single entire lamp surface of the device, and each of the respective color diode groups is arranged neatly without being mingled among these different color light emitting diodes for avoiding confusion, the printed wiring arrangement in this example is little complicated as compared with the arrangement shown in FIG. 1.

FIG. 10 shows a circuit diagram for actuating three groups of different color light emitting diodes. The full-wave rectifying circuit 6 and the smoothing capacitor C are similar to those in FIG. 4. A selection switch means 10 is provided and is adapted to select the connection of one of the three groups of the three different color light emitting diodes 3R, 3Y and 3G which, in turn, are provided at the ends of the rows thereof with their own protecting resistors $R_{11}$, $R_{12}$ and $R_{13}$, respectively. The respective groups 3R, 3Y and 3G are comprised of series connections of red, yellow and green light emitting diodes, respectively, and will emit red, yellow or green light by the selection of said switch connections. Although each group of color light emitting diodes is shown to include only one series connection, there may be connected a plurality of series connections in parallel relationship in each group in a manner as shown in FIG. 4. The group 3R of red light emitting diodes is connected to the power supply through the protecting resistor $R_{11}$ and via the selection switch 10. In case the rectified dc voltage is about 100 volts, about 60 red light emitting diodes each having a driving voltage of about 1.6 volts may be connected in series. It may be regarded that a red lamp is formed with the group 3R.

The yellow light source unit 3Y is comprised of a plurality of yellow light emitting diodes connected in series, and also is connected to the power supply through the protecting resistor $R_{12}$ and via the selection switch 10. In the similar way, the green light source unit 3G is comprised of a plurality of green light emitting diodes connected in series, and is connected to the power supply through the protecting resistor $R_{13}$ and via the selection switch 10.

FIG. 11 shows a cross-sectional view of the composite lamp assembly. A light source arrangement which is composed of a reflector unit 1 carrying thereon three groups of light emitting diodes of red, yellow and green colors and a substrate 12, is loaded in a housing 15 which, in turn, is provided with a transparent front cover lens 16. Lead wires generally indicated at 12*d* are derived from the rear surface of the substrate 12 to the outside of the housing 15 through an aperture which is formed through the rear plate of this housing 15. These lead wires 12*d* may be connected to a driver circuit 17 for selectively actuating any one of the red, yellow and green lights through switching action of the switch means 10, as desired. The front cover 16 may be in the form of a lens, and/or it may be slightly dyed to such degree as will not in fact alter the color of the emitting lights. The effect of external light rays incident to the front surface of the device may be reduced by dyeing the front cover lens 16 in light gray or black color. The housing 15 may be formed with an iron or steel plate or with a synthetic resin. The cover lens 16 may be formed with a glass pane or lens or with a synthetic resinous lens, and it may be tightly fitted in or adhered to the front opening of the housing 15 at the peripheral edges thereof.

Figure 12:
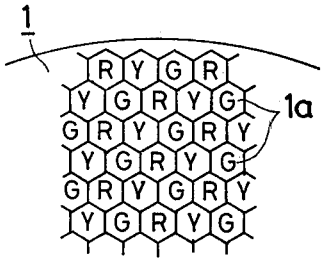

FIG. 12 shows the manner of arrangement of the colored light emitting diodes in three groups of 3R, 3Y and 3G on the front surface of the reflector unit 1. In the Figure, symbols R, Y and G represent red color, yellow color and green color, respectively, so that they also represent red, yellow and green light emitting diodes, respectively. These colored light emitting diodes are so arranged that light rays of either red, yellow or green color are caused to irradiate from the entire surface region of the front part of the device in accordance with the switching-over of the switch means 10 without uneven portions of irradiation. In order to effect this even irradiation for each of these three different colored lights, the arrangement of the respective groups of light-emitting diodes is made in the following manner. That is, each one red light emitting diode is surrounded by three yellow light emitting diodes and also by three green light emitting diodes. In the similar way, each one yellow light emitting diode is surrounded by red and green light emitting diodes, and each green light emitting diode is surrounded by red and yellow light emitting diodes. The selection switch 10 shown in FIGS. 10 and 11 is adapted to establish electric connection of any one group of light-emitting diodes which emit a selected colored light. Each unit mirror surface generally indicated at 1*a* in FIG. 12 has a hexagonal configuration and the unit mirror surface cells are arranged in a honeycomb shape. Such arrangement is fitted particularly for the display of three different color lights. It will be apparent that other types of arrangement may be employed also. It may be preferable from the veiwpoint of enhancing the evenness and uniformity of irradiation of light and luminous intensity to arrange a multiplicity of colored light emitting diodes in such manner that no adjacent two diodes emit a same colored light.

In this instant embodiment, the reflecting mirror unit 1 has its reflecting entire surface divided into a multiplicity of parabolic mirror unit surfaces, on each one of which unit surfaces is loaded a light-emitting diode. As stated above, a plurality of light-emitting diodes of red, yellow and green colors are distributed uniformly on the entire surface of the mirror unit. Those light-emitting diodes of a same color are connected in series to emit lights of a certain color at the same time. Apparently, two series connections of the same colored light emitting diodes may be connected in parallel in place of a single series connection. The selection of colored lights can be made by actuation of the selection switch, and different colored light displays can be obtained one after another color on a same reflecting surface of the device. By the adoption of light-emitting diodes, the service life of the lamp assembly is made semi-permanent. The man power and the cost which are required for maintaining the signal system in good order can be reduced markedly as compared with the conventional signal lamp devices. The fact that the provision of a coloring filter for coloring the irradiating light or a colored lens for such purpose is not required according to the present invention minimizes the attenuation of the intensity of the irradiating light caused by filter or lens. Thus, the power efficiency is improved and the power dissipation is reduced. Light-emitting diodes emit lights without generating heat, and hence there is required no particular means for the dissipation or radiation of heat. As a result, the structure of the lamp assembly can be greatly simplified in accordance with the present invention. In the conventional lamp signal system, the filter or lens which is disposed at the front surface of the device or housing thereof has a coloring effect, and could give a false indication when sunlight or other external lights impinge onto the filter or lens. In the instant embodiment, the front cover lens has no coloring function, and accordingly gives out no false indication. Thus, the ability of keeping the traffic in security is greatly improved.

Description will hereunder be made of signal display of letters or symbols.

Figure 13:
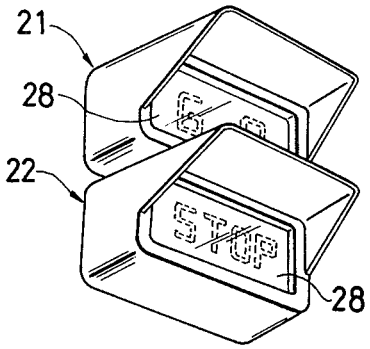

FIG. 13 shows a perspective view of a character (or letter) display signal device, in which a "GO" signal lamp 21 and a "STOP" signal lamp 22 are paired to constitute one complete signal display device. The "GO" sign is displayed in a green color light, whereas the "STOP" sign is displayed in red color light through a front cover lens 28. A reflector unit of a similar structure is provided for each of these two signal lamps and a plurality of light-emitting diodes are mounted on these reflector units to perform a predetermined character or letter display one at a time.

Figure 14:
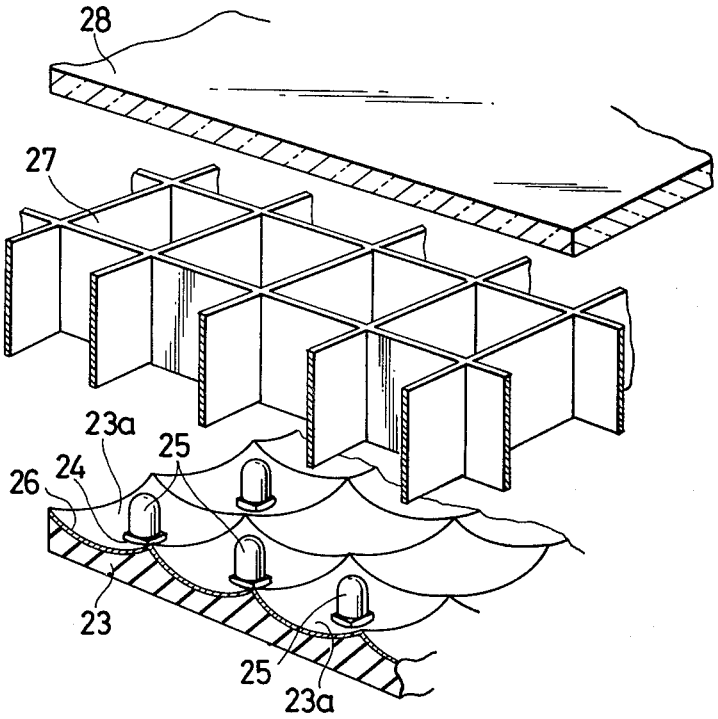

FIG. 14 shows an inner structure of one of such paired signal lamps. The structure of the other signal lamp of the pair is similar thereto, except for the difference in the letters or characters. A reflector mirror unit 23 is made of a synthetic resin, and its front surface is divided into a multiplicity of concave cellular sections, each section being formed to provide a reflecting area 23*a* having a parabolic surface. Light-emitting diodes are selectively mounted onto the central portions of predetermined reflecting areas 23*a* through mating sockets 24 or through holes to constitute a display letter. The front surfaces of the respective reflecting sections or areas 23*a* are deposited with aluminum to form a reflecting layer 26 of a high reflecting ability. While light-emitting diodes are mounted to form a predetermined pattern, a lattice-shaped frame 27 is positioned between the front cover lens 28 and the reflector unit 23 in such manner that the respective spaces defined by the walls of the lattice-shaped frame correspond to the respective reflecting areas 23*a* and to surround the respective light-emitting diodes 25. Namely, each light-emitting diode is isolated in a space defined by a reflecting area 23*a*, the walls of the frame 27 and the front cover lens 28. The front cover lens 28 may be transparent or neutral gray.

Figure 15A:
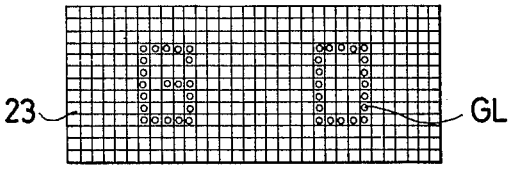
FIGS. 15A and 15B are a diagrammatic front view showing the arrangement of light-emitting diodes for providing letter signals.
Figure 15B:
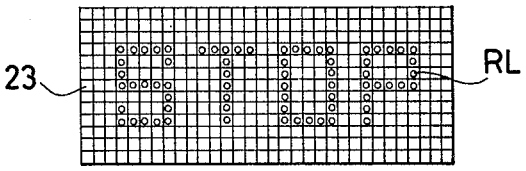

FIGS. 15A and 15B show an example of the display letters. FIG. 15A shows a "GO" signal lamp and FIG. 15B shows a "STOP" sign lamp. The light-emitting diodes GL which are mounted in the "GO" signal lamp emit green lights, while those RL mounted in the "STOP" sign lamp emit red lights. These light-emitting diodes are disposed on selected reflecting areas so as to form these letters for a desired display.

Figure 16:
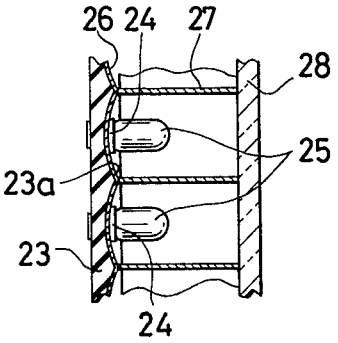

FIG. 16 shows a cross-sectional view of a signal lamp shown in FIGS. 15A and 15B. It will be apparent that a multiplicity of cells are defined by the reflecting areas 23*a*, the walls of the frame 27 and the front cover lens 28. Light-emitting diodes 25 are mounted in the selected cells.

FIG. 17 shows a circuit connection diagram for the light-emitting diodes of the device shown in FIGS. 13, 14, 15A, 15B and 16. The "STOP" sign lamp includes red light emitting diodes $RL_1$, $RL_2$, . . . $RL_n$ which are connected in series and constitute the letters "STOP", while the "GO" signal lamp includes green light emitting diodes $GL_1$, $GL_2$, . . . $GL_n$ which are connected in series and constitute the letters "GO". These series connections are arranged in parallel and are selectively connected to the rectifying circuit 6 through the selection switch 10. The capacitor C absorbs ripple components of the rectified dc current. It will be apparent that a rectifying and smoothing circuit may be provided for each of the red light emitting "STOP" signal lamp and the green light emitting "GO" signal lamp. Such arrangement may be preferable for compatible use in the conventional bulb-type signal system also. Also, one signal lamp includes a plurality of light-emitting diodes of series connections for the "STOP" signal, and the other lamp signal includes a plurality of light-emitting diodes of series connection for the "GO" signal, and these two signal lamps are switched-over on and off alternatley. It should be understood that the light-emitting diodes in each of these signal lamps are lighted up simultaneously. By effectively utilizing the small dimension of each light-emitting diode, a "STOP" signal lamp and a "GO" signal lamp may be integrated in a single housing.

FIG. 18 shows a composite "STOP and GO" signal lamp device which can selectively display "STOP" or "GO" sign on a same display surface. A multiplicity of unit concave mirror areas are formed on a mirror unit, and two groups of light-emitting diode are disposed at selected positions. The group of a required number of red light emitting diodes displays the "STOP" sign, whereas the group of a required number of green light emitting diodes displays the "GO" sign. Namely, two sign-indicating signal lamps are superposedly disposed on a single reflecting unit. This embodiment is not limited to the "STOP" and "GO" signal, and many variations are possible. For example, a plurality of groups of the same colored light emitting diodes can be selectively actuated on a single display surface, or different color sign displays may be arbitrarily superposed on a single display surface.

There may occur such case where different colored light emitting diodes preferably are disposed on a same unit mirror section. A paired or composite light-emitting diodes as shown in FIG. 19 may be used in such cases, in which one light-emitting diode is to be selectively actuated. In short, different signs of different colored lights or a same colored light can be displayed on a same display surface by superposedly disposing groups of light-emitting diodes of different colors or a same color.

In this embodiment, red, yellow and/or green light emitting diodes are used for displaying a predetermined pattern or patterns or letters. These light emitting diodes are disposed on a signal display surface at selected positions for representing a predetermined display pattern. Each light-emitting diode may be surrounded by frame walls for isolating each display unit. Thus, desired signal signs can be displayed in accordance with the selected pattern. Furthermore, the employment of light-emitting diodes eliminates the provision of a coloring filter, and no colored display can be performed unless the light-emitting diodes are actuated. Thus, even when sunlight or other intensive lights irradiate onto the surface of the signal lamp, no false indication will take place. The enclosure of the frame wall avoids the influence of external lights except for normal incident lights, and also prevents diverging diffusion of the emitting lights. Thus, signal letters or pattern(s) can be displayed sharply with a clear image. It will be needless to repeat that this substitution of an incandescent lamp by light-emitting diodes which is possible according to the present invention makes the service life of the lamp semi-permanent, and reduces the power consumption to an extremely small level. Thus, the maintenance care and running cost can be extremely simplified and reduced.

FIG. 20 shows another embodiment of signal display device, in which a shadow figure against a particular background represents a signal. A signal lamp 31 shows the shadow of a walking person 35 on a green background, and expresses a "GO" sign, whereas a signal lamp 32 shows the shadow of a standing (waiting) person 36 on a red background, and expresses a "STOP" sign. These lamps are placed together to provide one set of signal device and include respective front lenses 33 and 34 on which the shadows are illustrated by respective light-absorbing materials. Inside the lamp housing, a reflecting member having a plurality of parabolic mirror unit sections as shown in FIG. 2 are installed, and light-emitting diodes are disposed on these mirror sections. In this embodiment, no frame walls are provided for dividing the light-emitting diode cells.

The circuit connection of each signal lamp may be like that shown in FIG. 4 or like any one shown in FIGS. 5 to 8. Indeed, a single series connection may be used.

The signal lamps 31 and 32 for displaying respective shadow figures may be integrated into one composite lamp as is the case in FIG. 18.

FIG. 21 shows a front glass pane of such composite signal lamp. On a front cover lens 37, figures of a walking person 38 and a standing person 39 are superposedly formed with a green light absorbing material and with a red light absorbing material. The paint or dye for drawing the shadow figures should absorb the light of one color but not the other color. Therefore, when green light is emitted from the rear side of the front cover lens 37, those light rays which are incident onto the figure of a walking person are absorbed, and the black shadow of a walking person is displayed. Here, the paint or dye used for drawing a standing person does not absorb green light, and transmits the green light. In the similar way, when red light is caused to irradiate from the back side of the front cover lens 37, those light rays which are incident onto the figure of a standing person are absorbed, and the black shadow of a standing person 39 is displayed. At such time, the figure of a walking person transmits the red light, and does not affect the display of a standing person. Namely, shadow figures of different meanings are superposedly formed on a front cover lens with paints or dyes of different natures. For example, these figures may be formed with transparent dyes of complementary color to the subject color of the light-emitting diodes. In the above-mentioned case, the figure of a walking person may be colored in red, and the figure of a standing person may be colored in green. When green light emitting diodes are turned on, the emitting green light cannot transmit the red figure of the walking person, and hence a black shadow of a walking person is displayed on green background. Similarly, when red light emitting diodes are turned on, the emitting red light cannot transmit the green figure of the standing person, and hence a black shadow of a standing person is displayed on the red background.

These red and green light sources may be provided by disposing red and green light emitting diodes as shown in FIG. 22. In FIG. 22, the reflecting unit has a multiplicity of unit concave mirror sections, each having a square shape. These unit concave mirror sections are disposed in rows and coloumns, and red light emitting diodes R and green light emitting diodes G are aligned alternately.

In the above-stated embodiment, plural groups of light-emitting diodes of different colors are used as light sources for selectively emitting lights of different colors. The front cover panel or lens of the signal lamp assembly is transparent with no color, or dyed in neutral gray, and carries a pattern or patterns or a figure or figures dyed in a color complementary to the selected color of the lights emitted from the light-emitting diodes. By actuating the light-emitting diodes of a selected color, the pattern of figure having the complementary color is displayed in black or dark gray against the colored background where the lights from the light-emitting diodes are caused to irradiate directly. When two or more patterns are superposed on the front cover lens, each pattern is dyed in such manner that light of a selected single color is absorbed thereat. Thus, different and independent displays can be provided on a same display surface.

Unless a selected group of light-emitting diode is actuated, no colored display with a black shadow can be displayed. Thus, even when intensive external lights are incident onto the front lens, no false indication will appear. This ensures a high security of the traffic. Furthermore, the employment of light-emitting diodes as the light sources provides almost maintenance-free signal system of a semi-permanent service life, and also enables a marked reduction of power consumption to be obtained.

Although limited embodiments of the present invention have been described above, the scope of the present invention is not limited thereto. Various combinations of the respective constituent elements, modifications and alterations thereof will be apparent to those skilled in the art.

What is claimed is:

1. A colored light emitting display device comprising:

a substrate carrying thereon electric connection wirings;

a reflector member disposed on said substrate and having thereon a plurality of unit mirror sections of a similar shape; and a plurality of light-emitting diodes disposed on at least part of all of said unit mirror sections and connected to form a display circuit through said electric connection wirings.

2. A colored light emitting display device according to claim 1, wherein:

said reflector member includes a support plate made of a sythetic resin and having a plurality of unit concave surface formed on one side thereof and a metal mirror surface deposited on these unit concave surfaces, thereby providing said plurality of unit mirror sections.

3. A colored light emitting display device according to claim 2, wherein:

each of said unit mirror sections has a parabolic mirror surface.

4. A colored light emitting display device according to claim 2, wherein:

each of said unit mirror sections has a spherical mirror surface.

5. A colored light emitting display device according to claim 2, wherein:

some of said unit mirror sections have parabolic mirror surfaces and others of said unit mirror sections have spherical mirror surfaces.

6. A colored light emitting display device according to claim 2, 3, 4 or 5, wherein:

said reflecting member further includes a transparent protective film coated on an aluminum mirror surface.

7. A colored light emitting display device according to claim 2, wherein:

said display circuit includes a first series connection of light-emitting diodes displaying a predetermined first color.

8. A colored light emitting display device according to claim 7, wherein:

said display circuit further includes a second series connection of light-emitting diodes displaying a predetermined second color.

9. A colored light emitting display device according to claim 8, wherein:

said display circuit further includes a third series connection of light-emitting diodes displaying a predetermined third color.

10. A colored light emitting display device according to claim 8 or 9, further comprising a selection switch connected to said display circuit for selecting at least one said series connections.

11. A colored light emitting display device according to claim 1, 2, 3, 4, 5, 7, 8 or 9 further comprising:

a lamp base of a predetermined shape coupled to said substrate.

12. A colored light emitting display device according to claim 1, 2, 3, 4, or 5, further comprising:

a plurality of socket means for supporting and connecting said plurality of light-emitting diodes, disposed on said unit mirror sections.

13. A colored light emitting display device according to claim 1, 2, 3, 4 or 5, wherein: said reflecting member has a plurality of through-holes formed at central portions of said unit mirror sections, respectively, and said plurality of light-emitting diodes are connected to said electric connection wirings on said substrate through said through-holes, respectively.

14. A colored light emitting display device according to claim 8, wherein:

said unit mirror sections each has a square shape, and these sections fill an area of the surface of said reflecting member.

15. A colored light emitting display device according to claim 9, wherein:

said unit mirror sections each has a hexagonal shape, and these sections fill an area of the surface of said reflecting member.

16. A colored light emitting display device according to claim 1, further comprising:

a housing accomodating said substrate, said reflecting member and said plurality of light-emitting diodes, and having a transparent front cover panel.

17. A colored light emitting display device according to claim 16, wherein:

said front cover panel is dyed in neutral gray.

18. A colored light emitting display device according to claim 17, wherein:

said housing includes, on said front cover panel, a pattern formed with a colored transparent material having a color complementary to the color of lights to be emitted from at least part of said plurality of light-emitting diodes.

19. A colored light emitting display device according to claim 18, wherein:

said housing includes, on said front cover panel, another pattern formed with another transparent colored material of another color complementary to the color of lights to be emitted from at least another part of said plurality of light-emitting diodes.

20. A colored light emitting display device according to claim 16, further comprising:

frame walls disposed between said reflecting member and said front cover panel and defining a plurality of cells, each cell having a bottom formed with said unit mirror section, side walls formed with said frame walls and a roof formed with said front cover panel.

* * * * *